United States Patent [19]

Bekedam

[11] Patent Number: 4,648,355

[45] Date of Patent: Mar. 10, 1987

[54] HEAT EXCHANGER ARRAY FOR A STEP DOWN RETURN OF CONDENSATE

[76] Inventor: Martin Bekedam, 103 Brookline, Moraga, Calif. 94556

[21] Appl. No.: 798,923

[22] Filed: Nov. 18, 1985

[51] Int. Cl.[4] ..... F22D 1/00; F22D 1/32

[52] U.S. Cl. ..... 122/412; 34/119; 165/40; 165/113; 165/154; 165/156

[58] Field of Search ..... 165/154, 156, 159, 179, 165/113, 40; 34/119; 122/412

[56] References Cited

U.S. PATENT DOCUMENTS

| | | | |
|---|---|---|---|
| 2,885,790 | 5/1959 | Cram | 34/119 |
| 2,952,297 | 9/1960 | Hollis | 34/119 |
| 3,251,138 | 5/1966 | Whittaker | 34/119 |
| 3,802,499 | 4/1974 | Garcea | 165/159 |

FOREIGN PATENT DOCUMENTS

| | | | |
|---|---|---|---|
| 500389 | 2/1939 | United Kingdom | 165/156 |
| 854410 | 11/1960 | United Kingdom | 122/142 |

*Primary Examiner*—Albert W. Davis, Jr.

*Attorney, Agent, or Firm*—Bielen and Peterson

[57] ABSTRACT

A heat exchanger with straight tubes for convenient cleaning and repair is constructed with superior heat exchange capabilities. The heat exchanger has an outer shell with a fluid entry and exit and end plates which support one or more tubes with a fluid entry and fluid exit for each tube, the tubes having both an internal turbulence inducing structure and an external fin structure with periodic baffles for maximizing the heat exchange surface area and the contact of the exchange fluids with the exchange area.

3 Claims, 6 Drawing Figures

HEAT EXCHANGER ARRAY FOR A STEP DOWN RETURN OF CONDENSATE

BACKGROUND OF THE INVENTION

This invention relates to a heat exchanger for exchange of thermal energy from one substance to another. The heat exchanger is particularly useful for a variety of fluids including gases and liquids and is particularly suitable for high pressure systems and systems requiring periodic cleaning because of scale of surface fouling. The heat exchanger of this invention is primarily related to a double pipe heat exchanger in which a first pipe is concentrically positioned within a second pipe and one fluid flows through the inside pipe and the second fluid through the annular space between the outside and the inside pipe. The double-pipe heat exchanger is a simple system to construct and is capable of operating at relatively high pressures because of the generally moderate diameter of the outer pipe compared to the diameter of the outer shell of a multitube exchanger. However, the limited surface area renders the double-pipe system inadequate for most heat exchange situations. Further, the uniform annular and uniform circular cross sections of the fluid conduits promote laminar flow which characteristically inhibits effective transfer of heat from one fluid to the other. While multiple tube heat exchangers provide a substantial increase in surface area for component length, the shell encasing the tubes must be specially fabricated to contain and support the bundle of tubes at customary operating pressures, usually in excess of 150 psi. Further, such multiple tube heat exchangers are difficult to service for cleaning or repair and are expensive to fabricate. While baffles are frequently provided within the shell to direct the flow of the fluid outside of the tubes back and forth across the tubes, the heat transfer area is limited to the surface area of a tube multiplied by the number of tubes in the tube pack.

The straight tube heat exchanger of this invention is particularly useful in conjunction with a boiler and deaerator for condensing return steam and preheating boiler supply water. When used in an array of two or more exchangers the devised heat exchanger array uniquely permits steam return at multiple different temperatures often encountered in various manufacturing processes. This solves the vexing problem of multiple steam circuits each requiring its own pressurized receiver and high pressure pump for return of the condensate to the boiler. These and other features are described hereafter.

SUMMARY OF THE INVENTION

The heat exchanger of this invention is directed to an inexpensive and easily maintained double-tube system that is substantially enhanced to multiply the effective heat transfer surface and efficiency of the transfer. A primary consideration in the design of this heat exchanger is the low-cost of fabrication with accompanying ease of repair and servicing. The design permits a relatively high pressure system to be constructed with conventional component materials. The heat exchanger is of a straight, double-tube type, with an outer tube and a concentrically oriented inner tube. The inner tube, however, includes a series of heat exchange fins and interspaced alternately opposed baffles which direct a turbulent flow of fluid between inner and outer tubes back and forth across the inner tube. The inner tube also includes an internal turbulence generating ribbon which prevents a poorly conductive laminar flow through the tube.

The heat exchanger of this invention is uniquely useful in a staged array for condensing steam from multiple sources each at a different temperature and pressure. This situation is frequently encountered in boiler systems servicing different steps in a manufacturing process each step having a different steam requirement such that the spent steam condensate at each step may have substantially different pressures. To prevent flash loss of steam from this condensate each operating pressure circuit must have a pressurized receiver and high temperature pump to return the condensate directly to the boiler. The boiler would additionally require a separate feed water system to add new makeup water. Alternately, if all the high temperature, high pressure condensate were returned to a single feed water system, a flash loss of steam from 10–20% can be expected depending on the quantities and pressure differentials of the steam in the various processing circuits.

The staged array of heat exchangers of this invention uniquely couples multiple steam return circuits with a heat exchanger array for staged reduction of temperature and pressure for supply of condensate to a single low pressure deaerator. Concurrently, boiler feedwater is sequentially raised in temperature at each stage in the array, recovering the heat of the staged condensation by a counter current flow from the lowest temperature exchanger to the highest temperature exchanger.

The number of exchanger stages in an array is dependent on the requirements of the manufacturing process. Where required, multiple exchangers can be arranged in parallel at any stage as an alternative to increasing the size of the exchangers to achieve a balanced circuit.

The relatively simple three stage array described in the Detailed Description of the Preferred Embodiment is an exemplar of a heat exchanger array for a dual pressure return system for a corrugator machine. The arrangement of the exemplar is a typical array, and is shown as an example only and not to limit the various array configurations clearly possible from this disclosure. These and other features will become apparent upon a consideration of the detailed description of the preferred embodiment.

DETAILED DESCRIPTION OF THE PREFERRED EMBODIMENTS

Figure 1:
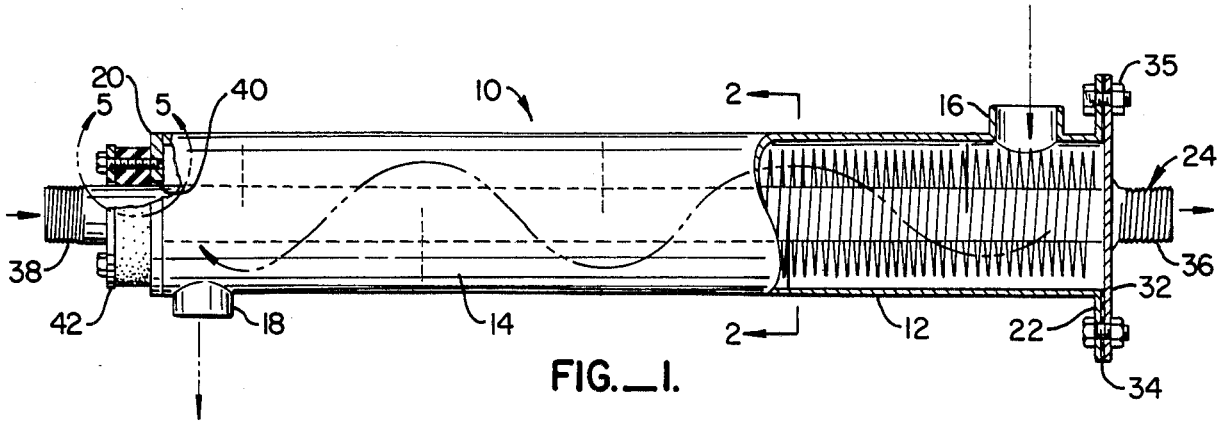
FIG. 1 is a side elevational view partially in cross section of the heat exchanger of this invention.

Referring to FIG. 1 the heat exchanger of this invention, designated generally by the reference numeral 10, is shown. The heat exchanger 10 is a straight double tube type that can be used alone or in a bank for fluids in liquid, gas or condensate form. The heat exchanger is constructed with an outer tubular shell 12 having a cylindrical body 14 with a fluid inlet 16 and outlet 18 at opposite ends of the body. The body 14 includes a fixed end plate 20 at one end and flange 22 at the opposite end.

Figure 2:
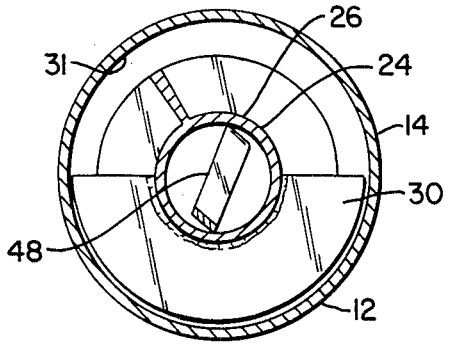
FIG. 2 is a cross sectional view taken on the lines 2—2 in FIG. 1.
Figure 3:
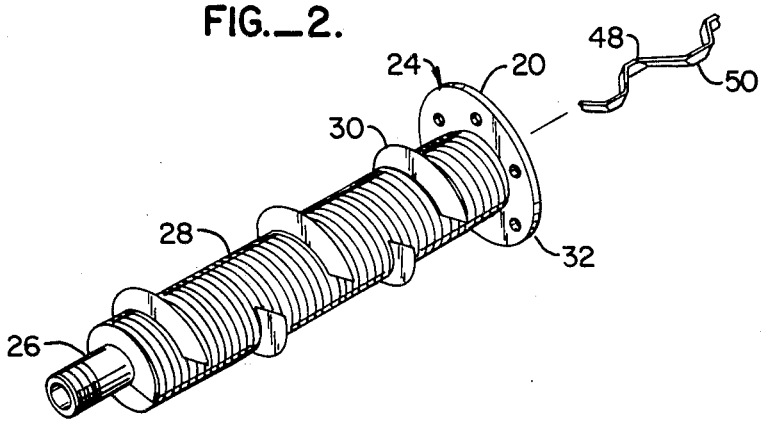
FIG. 3 is a perspective view of the inner pipe and extracted turbulator.
Figure 5:
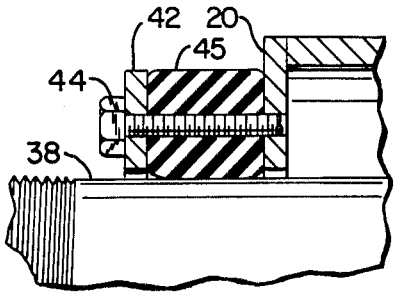
FIG. 5 is an enlarged fragmented cross sectional view of the packing seal arrangement.

Contained within the shell 12 is an inner conduit assembly 24 fabricated with a tube 26 having a helical fin 28 and a series of semicircular baffles 30, shown in FIGS. 2 and 3. As shown in FIG. 3 the shell has an inner wall 31 that is proximate the outer periphery of the baffles with tolerance for thermal expansion differentials. The wall 31 is displaced from the outer periphery of the fins to allow for fluid flow. The baffles 30 are spaced along the tube in an alternating opposite manner such that a fluid traveling between the outer tubular shell 12 and the inner tube 26 must travel a serpentine path back and forth between the fins as the fluid progresses from inlet to outlet. The diameter of the disk-like baffles is approximately the inside diameter of the shell 12, allowing the inner conduit assembly 24 to be installed and withdrawn from the shell 12. The conduit assembly 24 includes a disk flange 32 welded around one end of the inner tube 26, which couples to the flange 22 of the shell 12, sandwiching an appropriate gasket 34 therebetween. A series of bolts 35 allows for convenient uncoupling of the conduit assembly 24 from the shell for inspection or servicing. A threaded extension 36 of the tube projects from the flange 32 for coupling to conventional pipe fittings. The opposite end of the tube similarly includes a threaded extension 38 which projects through a center hole 40 in the fixed end plate 20. To seal this end, a cap plate 42, as shown in FIG. 5, is coupled to a series of stud bolts 44 connected to the end plate 20. The cap plate 42 compresses a packing 45 that on tightening a series of nuts 46 causes compression and sideways expansion of the packing against the tube resulting in a tight seal.

Figure 4:
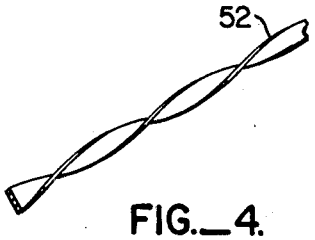
FIG. 4 is a perspective view of an alternate style turbulator.

In order to prevent a laminar flow within the inner tube, a turbulator 48 is inserted inside the tube. The tubulator comprises a bent metal ribbon bar 50 as shown extracted from the conduit assembly 24 in FIG. 3, or a twisted metal ribbon bar 52, shown in FIG. 4, for small diameter inner tubes. As the fluid passes through the tube the flow is interrupted and becomes turbulent providing a more thermally homogeneous contact of the fluid with the inner wall for effective heat exchange.

The heat exchanger of this invention is useful in a variety of liquid/liquid gas, gas/gas or liquid/gas applications in concurrent or countercurrent flows. The heat exchanger can be used individually and sized according to the job required or in parallel banks. Because of the simplicity of construction the heat exchanger can be carried in length conveniently up to a standard twenty foot length. Alternately, units can be connected in series to achieve particular application specifications.

A preferred use of the devised heat exchangers is in multiples in an array for a boiler system, particularly to solve the vexing problem of multiple, different pressure, return lines to the boiler from the service.

For example in the four following manufacturing processes the steam circuit pressures listed are typical for the multiple steam circuits required for different sections of the typical process.

| Corrugation Machines | |
|---|---|
| 1st section | 2nd section |
| 180#/sq. in. @ 380° F. | 160#/sq. in. @ 370° F. |

-continued

| Plywood Dryers | |
|---|---|
| 1st section | 2nd section |
| 250#/sq. in. @ 400 F. | 200#/sq. in. @ 388° F. |

| Paper Mills | | |
|---|---|---|
| 1st section | 2nd section | 3rd section |
| 50#/sq. in. @ 298° | 70#/sq. in. @ 316° F. | 150#/sq. in. @ 366° F. |

| Rendering Cookers | |
|---|---|
| 1st Section | 2nd Section |
| 150#/sq. in. @ 366° F. | 80#/sq. in. @ 324° F. |

Figure 6:
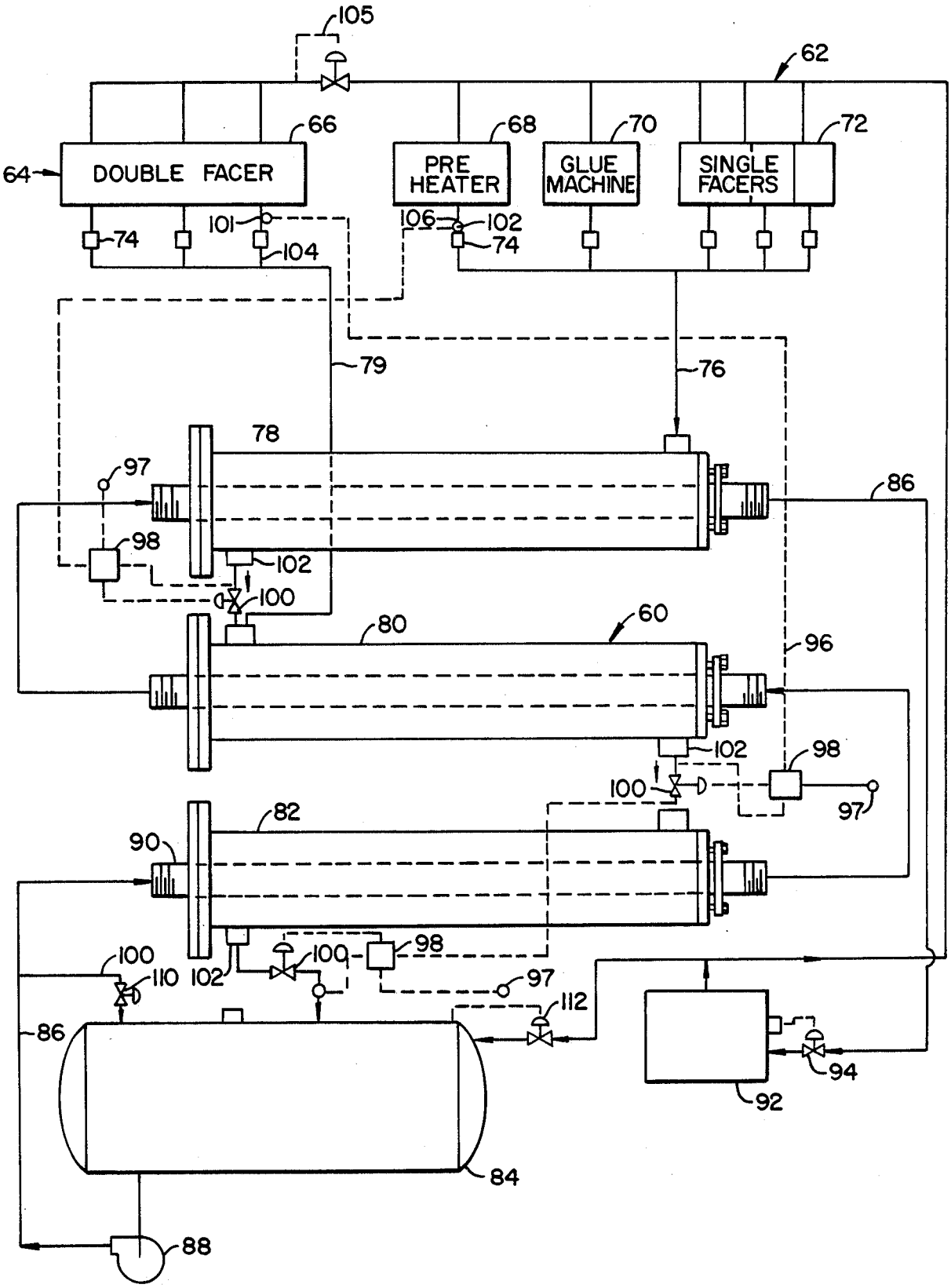
FIG. 6 is a schematic illustration of a heat exchanger array in an exemplar arrangement.

Referring to the schematic drawing of FIG. 6, an exemplar three-exchanger array 60 is shown for a steam supply system 62 for corrugator machine 64. The corrugator 64 is schematically shown having several operating components such as a double face 66, a preheater 68, a glue machine 70 and a single facer 72. Except for the double facer 66, the components utilize steam supplied at 180#/sq. in. @ 380° F. the double facer 66 utilizes steam at 150#/sq. in. @ 366° F.

In each of the two pressurized steam circuits, the latent heat of the steam is used such that the condensate collected by the condensate traps 74 is of essentially the same temperature and pressure as the steam. To combine the condensate of the higher pressure circuit with the lower would cause the condensate to flash. Therefore, the higher pressure condensate must be lowered in temperature before combining. This is accomplished by introducing the condensate from high pressure line 76 to a first heat exchanger 78 which lowers the temperature and pressure of the condensate, before combining the condensate with the condensate from the lower pressure line 79 of the double facer 66 in a second heat exchanger 80. Here the combined condensate is further lowered in pressure and temperature before entering a third heat exchanger 82 for final reduction of temperature and pressure for passage to the lower pressure deaeration 84.

Coolant for the heat exchangers in this system comprises the boiler feedwater from the deaeration 84. The feedwater passes from the deaeration 84 through feedline 86 by high pressure boiler feed pump 88 to the fore tube 90 of the lowest temperature third heat exchanger 82 in the three exchanger array of the exemplar system. As the feedwater cools the condensate, the feedwater is raised in temperature as the feedwater passes from the third exchanger 82 to the second exchanger 80 and finally to the first exchanger 78, where it exits to the boiler 92 through feedline 86 with a rise in temperature from 240° F. to 348° F. The heat exchanger array 60 in this aspect operates as a preheater for boiler feedwater supplied from the deaeration 84 to the boiler 92 as regulated by the boiler level control 94.

Control of the pressure in the heat exchangers 78, 80 and 82 is accomplished by a pneumatic control circuit 96 having an air supply 97. The control circuit 96 includes pressure differential regulators 98 to control pneumatically operated valves 100 at the exit ports 102 of the exchangers. The differential regulator utilizes sensors 101 to sense input pressures from the two pressurized sub circuits 104 and 106 separated by control valve 105 in the steam supply system 62 as reference pressures for controlling the respective exit port pressures.

Since the pressure drop resulting from the impedance of the heat exchanger is insignificant and does not match the line drop, there will be an initial flashing of the condensate entering each of the exchangers. In this aspect the exchangers also operate as a flash condenser where the flashed condensate condenses as it passes through the condenser. The inlet pressure of the first exchanger 78 is 150#/sq. in.; the second exchanger 80 is 130#/sq. in.; and the third exchanger 82 is 80#/sq. in. The pressure of the deaeration is 10#/sq. in. at 240° F. which is the base pressure and temperature facing the boiler feed pump. Makeup water is supplied to the deaeration from an external pressure source through line 108 and level control valve 110. Similarly makeup steam for the diaeration process is supplied from the boiler 92 through line 111 and control value 112. The deaeration is of conventional commercially available design such as the 0.005 Pressurized Jet Spray. Deaerator model 2.2 manufactured by Industrial Steam/-Kewanee Boiler Corp.

The foregoing arrangement describes one example of a heat exchanger array for step down return of condensate from different pressure condensate returns.

While in the foregoing embodiments of the present invention have been set forth in considerable detail for the purposes of making a complete disclosure of the invention it may be apparent to those of skill in the art that numerous changes may be made in such detail without departing from the spirit and principles of the invention.

What is claimed is:

1. A heat exchanger array for step down return of condensate in a vapor system having a vaporizer and a plurality of vapor sevices of different temperature and pressure having condensate reservoirs of relatively higher and lower pressures and temperatures, the array comprising:

a plurality of straight tube heat exchangers each of which comprises a straight outer tubular shell with an inside wall, having a fluid inlet and a communicating fluid outlet, and, an inner conduit assembly with fluid inlet and a communicating outlet concentrically mounted within the outer tubular shell, the conduit assembly having an inner tube with an external fin structure displaced from the inside wall and a periodic baffle structure proximate to the inside wall of the tubular shell;

wherein the straight tube heat exchangers are arranged with at least one heat exchanger having an inlet connected to a reservoir of relatively higher temperature and pressure and a communicating outlet connected to the inlet of at least one other heat exchanger the inlet of which is additionally connected to a condensate reservoir of relatively lower temperature and the communicating outlet of which is connected to a common return for the combined condensate, the array having further, pressure control means for regulating a pressure drop between the exchangers and cooling means for cooling the condensate in the exchangers.

2. The heat exchanger array of claim 1 wherein the vapor system is a steam system and the vaporizer is a steam boiler.

3. The heat exchanger array of claim 2 wherein the cooling means comprises boiler feedwater.

* * * * *